United States Patent [19]

Weintraub

[11] 4,435,025

[45] Mar. 6, 1984

[54] CLIMATE CONTROL SYSTEM

[76] Inventor: Steven A. Weintraub, 200 W. 86th St., New York, N.Y. 10024

[21] Appl. No.: 325,164

[22] Filed: Nov. 27, 1981

[51] Int. Cl.[3] ..... B01F 3/06

[52] U.S. Cl. ..... 312/31; 312/31.2; 312/31.3; 422/40

[58] Field of Search ..... 312/31, 31.01, 31.03, 312/31.04, 31.05, 31.06, 31.1, 31.2, 31.3; 422/40

[56] References Cited

U.S. PATENT DOCUMENTS

| | | | |
|---|---|---|---|
| 133,000 | 11/1872 | Yaw | 312/31 |
| 562,938 | 6/1896 | Toellner | 312/31.2 |
| 662,892 | 11/1900 | Dalton | 312/31 |
| 1,954,674 | 4/1934 | Lager | 312/31.3 |
| 2,506,806 | 5/1950 | Metzger | 312/31 |
| 2,539,587 | 1/1951 | Morse et al. | 312/31 |
| 2,994,404 | 8/1961 | Schifferly | 312/31 |
| 3,128,135 | 4/1964 | Ege | 312/31 |
| 3,205,049 | 9/1965 | Lannert et al. | 422/40 |
| 3,313,631 | 4/1967 | Jensen | 422/40 |
| 3,885,843 | 5/1975 | Rubel | 312/31 |

*Primary Examiner*—Victor N. Sakran
*Attorney, Agent, or Firm*—Paul J. Sutton

[57] ABSTRACT

The present invention teaches a novel system for controlling the climate of one or more of a variety of environments, particularly those in which valuable art objects are housed or displayed. This system contemplates an in situ reconditioning/regeneration method and apparatus whereby the use of two silica-type gels or a single silica-type gel in conjunction with a saturated salt solution located within a control volume effectively controls the relative humidity within the volume housing the valuable object sought to be preserved.

14 Claims, 4 Drawing Figures

10
12
14
16
18
20
22
24
26
28
42
46
48
60
61
64
65
72
76
78
84
88
2

10
12
16
18
20
22
24
26
30
32
34
36
38
40
42
44
46
48
50
52
54
56
58
60
61
62
63
64
65
66
68
70
72
74
76
78
80
82
84
86
88
92
94
96
98

CLIMATE CONTROL SYSTEM

The present invention relates generally to the preservation of art objects on display, and more particularly to a novel system for controlling the climate of one or more of a variety of environments in which art objects are housed or displayed.

It has long been recognized by those in the field of preserving and displaying valuable art objects, such as but not limited to museums, that there is a considerable burden associated with the reliable and efficient control of the relative humidity of the environment in which the objects are situated. A number of efforts in this area actually result in counterproductive damage to objects consisting of organic materials which may dry or crack.

Examples of other problems that are a source of concern to conservators include catalytic actions encouraged by ultraviolet sunlight rays and undesirable stresses and tensions induced by imbalanced heating of portions of the objects sought to be protected.

Conventional ways of dealing with these problems, especially those associated with controlling the humidity within display cases, include the use of silica gel materials normally found in laboratories where they are used as drying agents. These gel materials have characteristic moisture content values ("MC values"), and in museum applications they are utilized within screen holders or open trays.

However, where silica gel is normally used in museum applications, as an example, the gel must periodically be removed from the case and spread out in separate rooms for weeks at a time or placed in special reconditioning chambers in order to reestablish the desired MC value. This represents a significant undesirable use of labor, is relatively messy, requires otherwise valuable space which cannot be used for other purposes during these periods, and can further require a potential disturbance of the display case and its contents in order to gain access to the silica gel.

An object of the present invention is to provide what I refer to as a system in which silica gel is able to be reconditioned in situ, without removing and replacing the gel at all from the novel housing to be described below.

Another object of the present invention is to provide such a system wherein the display case comprising the general housing is rated such that a technician need only refer to a chart to determine the quantity of water or fluid to be added to accomplsh the reconditioning.

A further object of the present invention is to provide such a system wherein two distinct types of silica gel are utilized, one of which includes a regular silica gel and the other a special intermediate density silica gel having properties which include favorable decrepitation properties when in direct contact with water.

Still a further object of this invention is to provide such a system wherein water is added to the intermediate density silica gel in order to more easily control the rate of evaporation without artificially creating humidity "shock" or too rapid changes in relative humidity.

Another object of the present invention is to provide an alternate system to the two silica gel system wherein a regular silica gel and a saturated salt solution can be used in combination, the saturated salt solution being used in place of the gel of intermediate density.

Yet a further object of this invention is to provide such a system wherein water in the saturated salt solution is replenished in order to more easily control the rate of evaporation without humidity shock.

Yet another object is to provide such a system wherein gel is housed within porous plastic tubes constructed of 250 micron pore polypropylene, and having a shape such that an outer cylindrical surface is exposed to the environment and an inner core diameter surface is likewise exposed to the environment, thereby optimizing the surface area and bed depth of the gel. These tubes further provide the advantage of relative ease of installation, giving a designer maximum flexibility in how they can be placed in a case, and by varying the tube diameters and amounts of the gel contained therein, the overall system can be used to control humidity in volumes ranging from small storage boxes to enormous display cases.

Another object of the present invention is to provide a concept of a microenvironment utilizing nonmechanical means such as silica gels for the control of relative humidity and climate. Within one year prior to the filing date of the present specification with the U.S. Patent and Trademark Office, the system according to the present invention was tested successfully at The Metropolitan Museum of Art in New York City. In this successful test, silica gel was reconditioned in situ so as to maintain relative humidity within a specified range of a microenvironment.

Still a further object of the present invention is to provide a novel system of the type described herein, wherein the user is capable of controlling relative humidity in display or storage cases within older and historic buildings whose confines are sometimes very difficult to control insofar as relative humidity is concerned. This control of relative humidity is critical for the preservation of organic and inorganic art objects and artifacts.

The objects set forth in list form above and others not specifically recited are accomplished according to the present invention by providing a novel system which overcomes the disadvantages of mechanical environmental control systems normally thought of in terms of their maintenance problems. Before referring in more detail to the drawings, perhaps a few more words about the system generally should be set forth at this point within this specification.

It is worth repeating here that one of the biggest problems with utilizing silica gel to control relative humidity concerns the reconditioning of the silica gel at times when it can no longer maintain relative humidity within a specified range in its microenvironment. Generally, the silica gel is removed and reconditioned in a separate chamber spaced from its normal control chamber, and often at locations remote from the display area. In situations where large quantities of silica gel are used, this requires large physical and personnel requirements in order to maintain the transition gel adequately.

The present invention enables a reconditioning of the silica gel in situ. If the relative humidity becomes too low, the silica gel can be reconditioned in the case without directly handling or removing the silica gel. The water evaporates slowly enough for the silica gel to adsorb it without increasing the relative humidity within the display or storage case. It is known that the relative humidity value in the case should remain at a value which is a function of the moisture content of the gel and not be directly affected by the water added to regenerate the gel. This is accomplished by controlling the rate of evaporation of the regenerating water and by maximizing the surface area of the silica gel to be regenerated.

In the system of the present invention, a specific quantity of water is added, either directly or from outside the case, through a feed tube into a reconditioning trough containing intermediate density silica gel, known in the trade as ID 59 Silica Gel. Unlike regular silica gel, this gel does not decrepitate upon direct contact with water. This results from the intermediate density gel having a much higher pore volume than typical regular density silica gel.

Under the special circumstance where the case is opened frequently, that is, more than once a week, the intermediate density silica is replaced with an appropriate saturated salt solution.

The use of an intermediate gel results in a substantially lower rate of adsorption and more rapid heat dissipation, thus avoiding thermal stresses which can result in decrepitation. Since intermediate density silica gel has a moisture capacity of 93.5% at 100% relative humidity but only 6% capacity at 50% relative humidity, it is able to absorb almost its entire weight in water and will gradually desorb most of the water below 70% relative humidity. Thus, by controlling the bed depth and surface area of the intermediate density silica gel, the rate of evaporation is controlled to gradually recondition the regular silica gel without increasing the relative humidity in the case above the expected MC/RH value of the regular gel. It should also be emphasized that adding water to the intermediate density silica gel further eliminates the possible risk of spillage from free water in the case. Successful reconditioning of the regular silica gel is assured by maximizing its surface area in contact with the air and minimizing its bed depth. This is accomplished by means of the two housings which are described in more detail below.

Conversely, if the relative humidity becomes too high, a sufficient amount of dry silica gel, prepackaged in polypropylene tubing as described below, can be added to the case. The dry silica gel will adsorb a sufficient amount of excess moisture so as to reduce the moisture content of the regular silica gel so that the relative humidity in the display volume will be reduced to an acceptable range of humidity.

The effective distribution of regular silica gel within the case and in contact with the air is necessary to achieve an efficient transfer of moisture between the gel and its surroundings. Studies show that where moisture transfer between silica gel and its environment is quite rapid (depending on the size of the individual grains), the underlayers of silica gel take far longer to equilibrate in relatively static air. The distribution of the silica gel in depth, therefore, becomes a critical factor for several reasons. It will affect the ability of the regular gel (1) to recondition uniformly; (2) to respond to changes in RH rapidly; and (3) to use all the silica gel present in depth efficiently for both short and long term control of RH within the case.

At this point, it is desirable to refer to the drawings wherein similar reference characters denote similar elements throughout the several views and in which.

Figure 1:
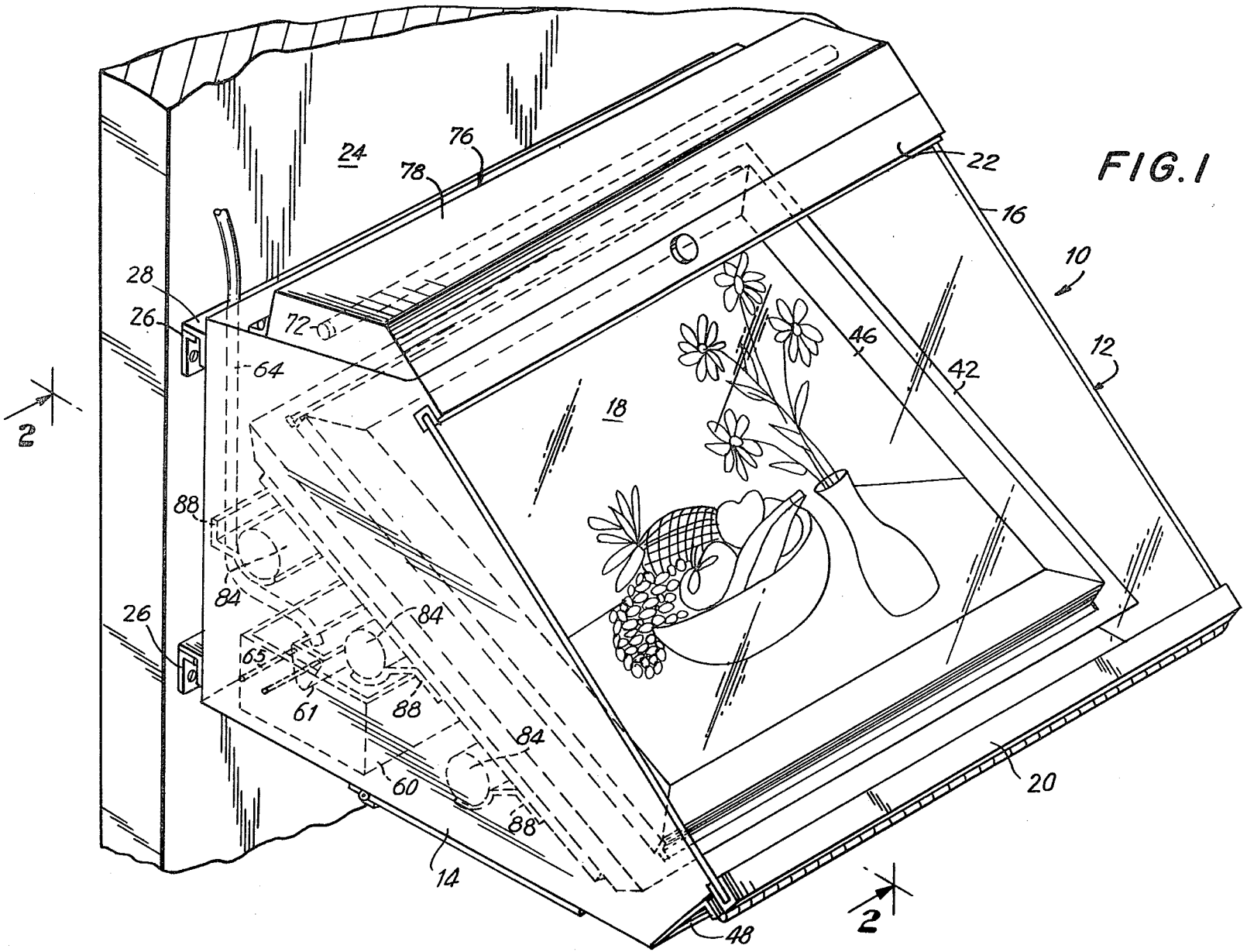
FIG. 1 is a a fragmentary perspective view of a display case system according to the present invention.

Referring now to FIG. 1, in this perspective-type view, an effort is made to show a system 10 according to the present invention wherein a housing 12 in the form of a display case is depicted as including spaced side walls 14 and 16 whose distance from one another may vary according to the desire of the user.

A transparent front window 18 is held at its lower end by grooved channel member 20 and at its upper end by a grooved channel member 22, provision being contemplated for hinged opening of window 18 where desired, or opening being prevented in museum environments wherein theft of or damage to artifacts or art objects is of concern. For purposes of illustration only, the entire housing 12 of system 10 is shown supported on a vertical wall 24 by means of wall angle brackets 26 and housing bracket 28. While the case or housing 12 is shown being supported from a vertical wall 24, the present invention contemplates any number of means of supporting the entire case, whether from vertical, angled or horizontal surfaces.

Figure 2:
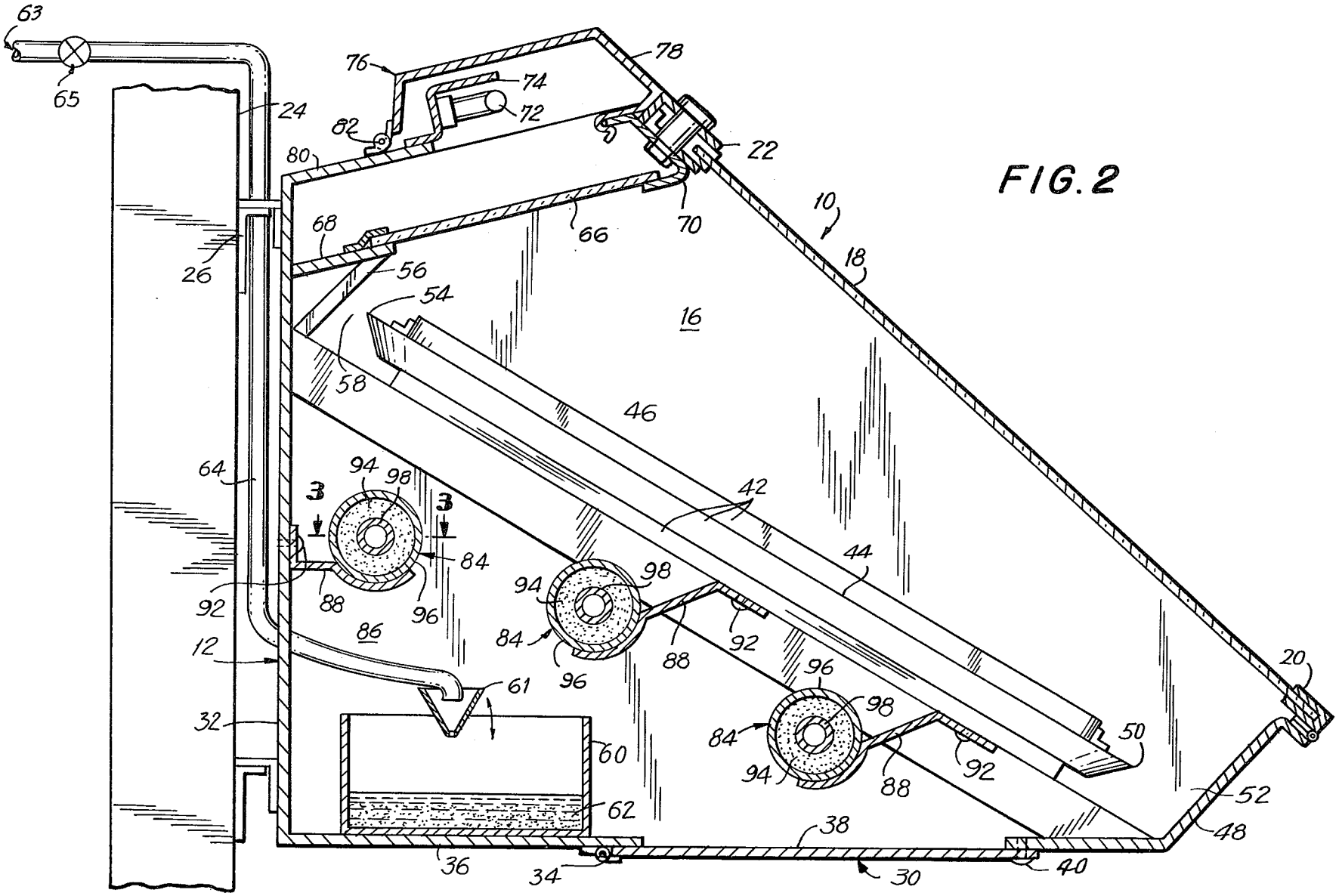
FIG. 2 is a fragmentary sectional elevational view taken and looking along the line 2—2 of FIG. 1.

Referring now to both FIGS. 1 and 2, it is seen that a segmented bottom wall or base 30 extends between channel member 20 and rear panel 32. A hinge 34 of the piano-hinge type pivotally interconnects segments 36 and 38 of base 30 such that, by removal of fastener 40, base segment 38 may be swung downwardly about the axis of hinge 34 in order to gain access to interior portions of housing 12 of system 10.

An interior panel 42 preferably formed of homosote or plywood and including an upper face 44 is preferably covered with a cloth for purposes of exhibition of a work of art or an artifact generally designated reference character 46 within FIG. 2. It should be noted here that panel 42 does not extend to or touch base segment 48, but rather terminates such that a gap between its end 50 and segment 48 exists. This gap has been assigned reference character 52.

Likewise, a gap is located between opposite end 54 of interior panel 42 and interior panel 56 of housing 12. This latter gap has been designated character 58.

An elongated main trough 60 having a length normally sits upon base segment 36 and is partially filled with an intermediate density silica gel characterized as 62. In use, a level of water used for reconditioning is introduced into a collecting trough 61, which is positioned above main trough 60 along its length, from a source of water 63 outside the housing by means of feed or filling tube 64 which extends through an opening in rear panel 32 to a position outside of the housing 12. The flow of water through tube 64 can be regulated by water flow control means at value 65. Thus, water can be introduced either into the collecting trough 61 through filling tube 64 from outside the housing, or directly by access through panel 38. The water is then dumped into the trough 60 containing ID 59 silica gel by pushing an extension arm 65 connected to the collecting trough 61 thus rotating the trough and inverting it. The purpose of this is to even distribution of the water in the ID 59 silica gel.

If a saturated salt solution is used in place of intermediate density silica gel, the solution is located in main trough 60 and water is added through filling tube 64 directly without recourse to collecting trough 61.

One or more layers of plexiglass panels 66 supported by brackets 68 and 70 permit the entry of fluorescent light from a bulb 72 supported by a bracket 74 within lighting fixture housing 76. A cover 78 of the lighting fixture 76 is supported on top housing panel 80 at hinge 82 to permit access to the interior portions of fixture 76 and plexiglass panels 66.

A plurality of tubular housings 84 are shown supported at predetermined locations without housing 12. More specifically, the chamber defined by base panel 30, rear panel 32 and interior panel 42, designated reference character 86 can be described and defined as a control volume within which relative humidity is controlled, varied and adjusted. Brackets 88 support tubular housings 84 from rear panel 32 and from a base support 92 secured to interior panel 42 by means of conventional fasteners 92.

For purposes of this specification, all of the tubular housings 84 are substantially identical, although they need not be and may be varied in diameter, length and other configuration. It should further be emphasized that a plurality of these tubular housings 84 is not necessary under certain circumstances where a single tube and its contents will suffice.

Figure 3:
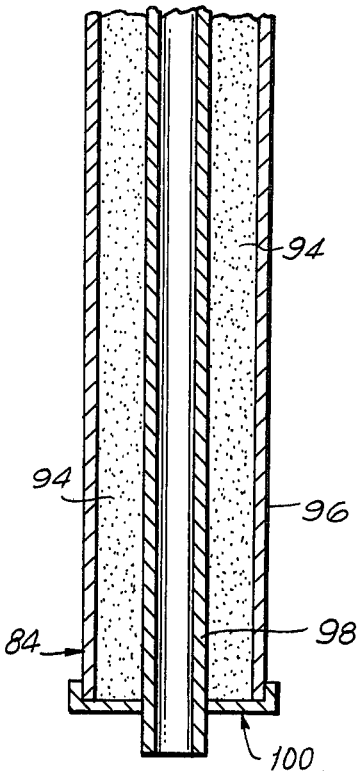
FIG. 3 is a fragmentary sectional plan view looking along the line 3—3 of FIG. 2.

Each of the tubular housings 84 holds or houses a quantity of what has previously been referred to as regular silica gel designated here as 94. Silica gel 94 is held between outer cylinder 96 in each case and inner cylinder 98, both cylinders being in every instance porous. This is best illustrated in FIG. 3, wherein a removable screwed end cap 100 is utilized to contain the silica gel 94 within tubular housing 84.

We thus see that by providing tubular housings 84 to contain silica gel 94, surface contact with air is maximized utilizing the porous cylinders previously referred to. Similarly, bed depth of this silica gel 94 is minimized by packing the gel within the narrow annular opening between outer and inner cylinders 96 and 98. These cylinders are preferably fabricated from polypropylene with an average porosity of 250 microns and with a wall thickness of approximately 1/16th of an inch. Because the tubes are constructed from polypropylene, the entire tube can be heated to 250° F. to dry out the silica gel without having to remove the gel if this becomes absolutely necessary.

It should be noted that the rate of response of the gel 94 to changes in relative humidity has not appeared to be significantly affected by the porous plastic tubular housings 84. Experience suggests that approximately ¾ of an inch is a reasonable sufficient maximum depth for the silica gel 94. This can be achieved either by using a 1½ inch diameter tube or a wider diameter tube with a hollow inner core. A preferred embodiment of the invention comprises a 2½ inch outer diameter with a 1 inch inner core.

It should now be obvious to the reader that a primary advantage of the system 10 outlined here and being described is its ease of maintenance. As in any silica gel system, the display case or housing 12 should have a minimum leakage, preferably no more than one air change per day. If allowances are made to recondition the gel in situ, there is no need to use the 12.5–20 kg. of gel per cubic meter of the volume being controlled recommended by authorities such as Thomson, since these figures are based upon carrying a case through semi-annual seasonal cycles without provisions for reconditioning the gel. Enough gel should be present, however, to minimize the need for maintenance. Depending upon the amount of leakage, the differences between the case and room relative humidities and the range of change in relative humidity permitted before the gel is reconditioned, housings 84 should be sufficient in storage capacity to accommodate 5 to 10 kg. of gel per cubic meter of volume being controlled for reasonable periods of protection. In environments wherein the presence of a sufficiently large amount of silica gel relative to other adsorbing materials is required (as well as a far larger MC value for silica gel than for organic materials that may be present in the case), only the silica gel need be taken into account when calculating a quantity of water to be added in order to recondition the silica gel in situ.

In adding water through filling tube 64, the trough 60 need contain only enough intermediate density silica gel so that it is fully saturated when the regenerating water is added. With the construction shown in FIG. 2, trough 60 will permit relatively slow evaporation over a period of time to allow for gradual reconditioning where the case or housing 12 humidity is substantially always equivalent to the moisture content of the regular gel 94, which is not directly affected by the water given off by the intermediate density silica gel.

Maintenance procedures according to the present invention provide that each case include a hygrometer which is periodically checked for accuracy of calibration. Housing or display case humidities are to be checked and recorded on a regular basis. Once a week should be adequate. In instances where any case or housing 12 exceeds its humidity limits, an information card containing the specific rating for that case should be consulted and reconditioning procedures carried out according to instructions on the card. These procedures can be carried out by relatively unskilled personnel by following simple instructions. This is a major feature of the present invention insofar as the ease of maintenance is concerned.

Another benefit of a silica gel system such as system 10 resides in its flexibility. Since the tubular housings 84 need not be touched during the lifetime of the case, they can be placed anywhere within the case, suspended horizontally or vertically. This is best illustrated by the alternate embodiment of system 10 shown in FIG. 4 of the drawings. Similarly, the length and diameter of the tubes can vary to suit a particular situation. This fexibility allows for inclusion of the tubular housings in existing display cases without any extensive modifications.

Undesirable characteristics of closed microenvironments include a risk of extremely rapid changes in relative humidity such as might result from rapid changes in temperature when direct sunlight hits the case, or where there is a buildup of pollutants from materials within the case. In the case of rapid changes of relative humidity, this problem is offset by including a sufficient quantity of powdered silica gel loaded paper or plastic, which allows the silica gel to respond to immediate changes in relatively humidity caused by rapid changes in temperature. Because the powdered silica gel responds so quickly to changes in relative humidity, it is useful as a buffer until the regular silica gel can fully respond. Likewise, sheets of activated charcoal impregnated paper can be placed in the case to serve as a pollution scavenger.

Figure 4:
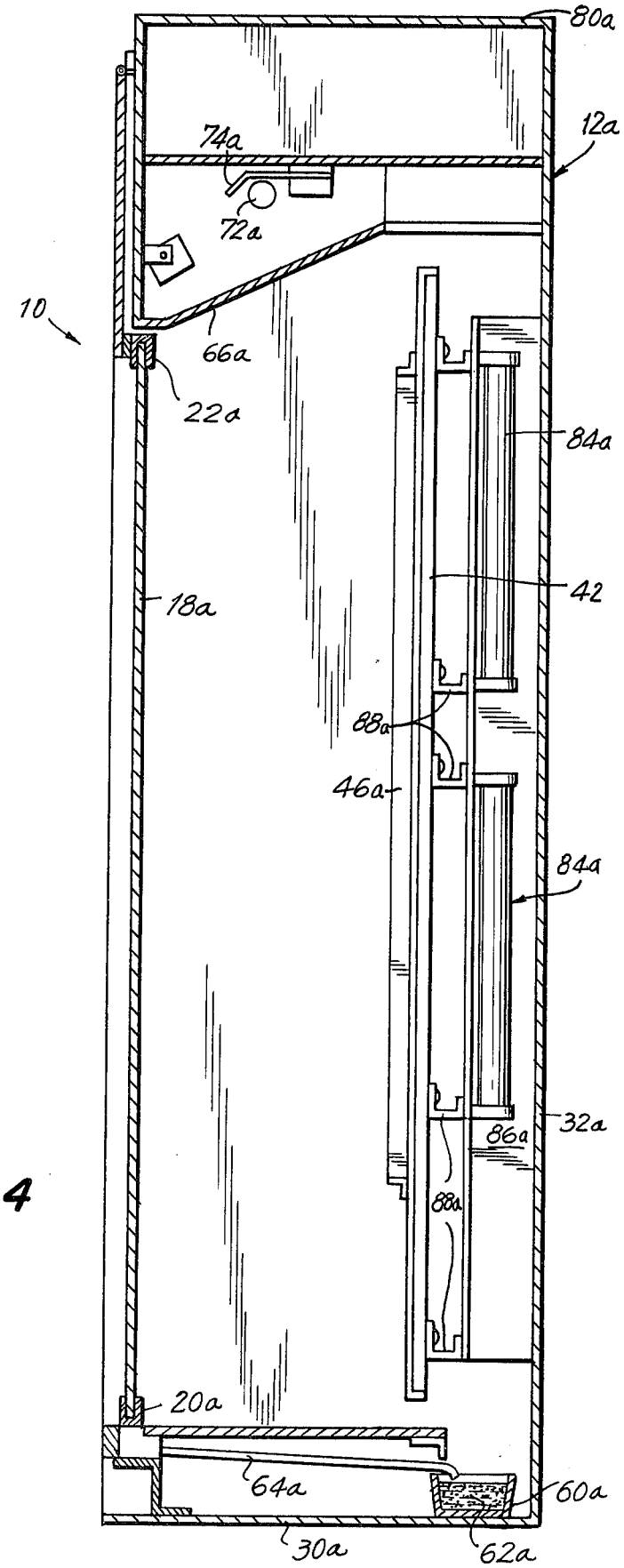
FIG. 4 is a sectional elevational view of an alternate embodiment of the present invention comprising the novel climate control system.

For the convenience of the reader, within FIG. 4, I have added the small suffix "a" to the reference characters assigned to FIG. 2 in order to show a correspondence between the two embodiments. Thus, housing 12 of FIG. 2 is compared with housing **12*a* of FIG. 4**, and so forth. This will give the reader an appreciation of the fexibility of the system of the present invention.

The present invention contemplates a modular system concept for controlling the climate of a volume. In this way, not only museum display cases are contemplated as housings utilizing the present invention, but private displays, retail store displays and storage containers wherein atmosphere control is important may be inexpensively and efficiently provided with the present invention.

While the present invention has been discussed by reference to specific embodiments, it should be understood by the reader that the objects initially set forth within the specification may be successfully achieved by other embodiments of the invention obvious to one skilled in the art. The embodiments of the invention particularly disclosed and described herein are presented merely as examples of the invention and are not meant to limit the invention. Other embodiments, forms and modifications of the invention coming within the proper scope and spirit of the appended claims will, of course, readily suggest themselves to those skilled in the art.

What is claimed is:

1. A system for controlling the climate of a volume within which an art object or the like is situated, comprising, in combination: a general housing defining a first control volume and a second display volume, said second volume being contiguous to or a part of said first volume, at least one smaller housing of predetermined size and shape disposed within said first control volume for housing a first control substance capable of removing moisture from or adding moisture to the confines of said general housing, a container disposed within said first control volume for holding a second control substance capable of holding and giving up moisture to the confines of said general housing, means for providing a fluid to said container, and means for supporting said smaller housing, said container further comprising a trough disposed within said first control volume, said trough being positioned directly above the length of said container, said trough being capable of being rotated and transferring said fluid in said trough into the length of said container, a tube for transferring said fluid from a source of fluid outside said general housing to said trough, means for controlling the flow of said fluid in said tube, and means for rotating said trough.

2. A system for controlling the climate of a volume according to claim 1, wherein said first control substance is regular silica gel.

3. A system for controlling the climate of a volume according to claim 2, wherein said second control substance is an intermediate density silica gel.

4. A system for controlling the climate of a volume according to claim 3, wherein said intermediate silica gel is ID 59 silica gel.

5. A system for controlling the climate of a volume according to claim 2, wherein said second control substance is a saturated salt solution.

6. A system for controlling the climate of a volume according to claim 5, wherein said means for providing a fluid to said container comprises a tube for transferring said fluid from a source of fluid outside said general housing to said container, and means for controlling the flow of said fluid in said tube.

7. A system for controlling the climate of a volume according to claim 2, said smaller housing being a porous tubular housing.

8. A system for controlling the climate of a volume according to claim 7, said porous tubular housing having an average porosity of approximately 250 microns and a wall thickness of approximately 1/16 of an inch.

9. A system for controlling the climate of a volume according to claim 8, wherein said porous tubular housing is made of polypropylene.

10. A system for controlling the climate of a volume according to claim 7, said porous tubular housing having an outer cylinder with a hollow inner core, said outer cylinder having a diameter of approximately $2\frac{1}{2}$ inches and said hollow core having a diameter of approximately 1 inch.

11. A system for controlling the climate of a volume according to claim 7, wherein said tubular housing is disposed substantially horizontally within said first control volume.

12. A system for controlling the climate of a volume according to claim 7, wherein said tubular housing is disposed substantially vertically in said first control volume.

13. A system for controlling the climate of a volume according to claim 1, wherein said second volume is a display volume, further comprising a panel member supported within said general housing with portions thereof spaced a predetermined distance from the interior walls of said general housing for separating said first and second volumes and for obscuring the contents of said first volume from viewers of said second volume.

14. A system for controlling the climate of a volume according to claim 1, wherein said fluid is water.

* * * * *